US007278452B2

(12) United States Patent
Taguchi et al.

(10) Patent No.: US 7,278,452 B2
(45) Date of Patent: Oct. 9, 2007

(54) FILLER FOR FILLING DRINK LIQUID

(75) Inventors: Masatake Taguchi, Tokyo (JP); Kazutaka Yamamoto, Tokyo (JP); Kaoru Ichihashi, Tokyo (JP)

(73) Assignee: Asahi Breweries, Ltd., Chuo-ku (JP)

( * ) Notice: Subject to any disclaimer, the term of this patent is extended or adjusted under 35 U.S.C. 154(b) by 320 days.

(21) Appl. No.: 11/143,727

(22) Filed: Jun. 3, 2005

(65) Prior Publication Data

US 2005/0279777 A1 Dec. 22, 2005

(30) Foreign Application Priority Data

Jun. 4, 2004 (JP) ..... 2004-166595

(51) Int. Cl.
*B65B 1/04* (2006.01)

(52) U.S. Cl. ..... 141/113; 141/91; 141/104; 141/348; 141/350; 137/212; 137/322; 251/149.1

(58) Field of Classification Search ..... 141/1, 141/2, 11, 18, 69, 70, 85, 89, 91, 100, 104, 141/113, 348–350; 137/212, 322; 251/149.1
See application file for complete search history.

(56) References Cited

U.S. PATENT DOCUMENTS 3,866,626 A * 2/1975 Johnston ..... 137/322
3,880,182 A * 4/1975 Johnston ..... 137/212
3,880,206 A * 4/1975 Johnston ..... 141/5
4,457,324 A * 7/1984 Schepper ..... 134/102.1
4,573,505 A * 3/1986 Lee et al. ..... 141/92
4,665,940 A * 5/1987 Jacobson ..... 137/212
5,649,575 A * 7/1997 Till ..... 141/90

* cited by examiner

*Primary Examiner*—Timothy L. Maust
(74) *Attorney, Agent, or Firm*—Venable LLP; Catherine M. Voorhees

(57) ABSTRACT

The drink liquid, such as beer, soft drink, etc., stayed in stay portion 5 of filler during the filling operation is recovered without dropping of the quality. The filler is composed of cylinder rod 4 connected to the cap 3 of container 2, discharge hole 7 longitudinally penetrated through a center of the cylinder rod 4, a stay portion 5 secured at the upper part of the periphery of cylinder rod 4, through which the drink liquid passes, and a supply pipe 6 for drink liquid connected to the stay portion 5, and characterized in that the storage equipment 12 for stayed liquid having storage room 18 is secured on supply pipe 6, and pipe 11 for introducing pressurized air is also secured. It is connected to stay portion 5 through discharge hole 7.

6 Claims, 7 Drawing Sheets

FILLER FOR FILLING DRINK LIQUID

BACKGROUND OF THE INVENTION

1. Field of the Invention

The present invention relates to a filler for filling drink liquid, such as beer, bubbled soft drink, etc. into a liquid container, such as a barrel. In particular, it relates to a filler for filling drink liquid which is capable of collecting a stayed liquid of the drink liquid stayed in the stay portion without dropping the quality thereof, when the drink liquid is filled into the container.

2. Description of the Prior Art

In the past, the filler for filling drink liquid shown in FIG. 8 is well known. In FIG. 8, the filler 1 for filling drink liquid is such a type that a container 2 is kept upside-down, and drink liquid is filled through a cap 3 from the lower part, and is composed of a cylinder rod 4 connected to the cap 3, a stay portion 5 secured at the upper part of the periphery of the cylinder rod 4, through which the drink liquid passes, and a supply pipe 6 for introducing the drink liquid into the inside of container 2 from the supply source not shown in FIG. 8.

The filler 1 of the FIG. 8 is operated in the following manner. At first, empty container 2 is carried with a carrying machine not shown in FIG. 8, and then, cylinder rod 4 is pushed up to open the cap 3 of the container 2 shown in FIG. 3, and at the same time, cylinder rod 4 is connected to container 2. Next, control valve 13 for drink liquid and control valve 15 for stayed liquid are both opened, and as a result, supply pipe 6 is connected to the inside of container 2 and drink liquid is introduced and filled into container 2 toward the direction shown by an arrow. At the same time, the air in the container 2 is discharged from container 2 toward the direction of an arrow, through pipe 10 for discharge air, discharge hole 7 longitudinally penetrated through a center of cylinder rod 4, and discharge line 8. At this time, stay portion 5 is occupied with drink liquid during the filling.

When the filling is reached to desired amounts, cap 3 of container 2 is closed by pulling down cylinder rod 4 as shown in FIG. 4, then, the filling of drink liquid is completed. The stayed liquid stayed in stay portion 5 is discharged through discharge line 9 connected to stay portion 5.

The drink liquid discharged to discharge line 9 is exposed to the open air, and the quality thereof is dropped down. If the drink liquid is re-used as a product, difficult treatments are necessary with big expenses. Then, drink liquid is obliged to be abandoned. Also, the improvements of the filler are carried out for decrease the stayed liquid, but is not satisfied even now.

SUMMARY OF THE INVENTION

It is, therefore, an object of the present invention to provide a filler for filling drink liquid which overcome the above-described drawbacks inherent in the known techniques and which are capable of collecting a stayed liquid of the drink liquid stayed in the stay portion without dropping the quality thereof, when the drink liquid is filled into the container through the cap from the bottom of the container.

To attain the above-described object, according to the present invention, there is provided a filler for filling drink liquid into a container from the bottom thereof through a cap, comprising a cylinder rod connected to the cap of the container, a discharge hole longitudinally penetrated through a center of the cylinder rod, a stay portion secured at the upper part of the periphery of the cylinder rod, through which the drink liquid passes, and a supply pipe for drink liquid connected to the stay portion, wherein each of the stay portion and discharge hole is respectively connected into the inside of the container by pushing up the cylinder rod to open the cap of the container, and the drink liquid is filled up into the container from the supply pipe through the stay portion, characterized in that a storage equipment for stayed liquid having a storage room is secured on the supply pipe, and a pipe for introducing pressurized air is secured to be connected to the stay portion through the discharge hole, thereby the stay portion and the discharge hole are shut off from the inside of the container by pulling down the cylinder rod and by closing the cap of the container, and then, the pressurized air is introduced into the stay portion from the pipe for pressurized air and the stayed liquid in the stay portion is introduced into the storage room through the supply pipe.

The feature of the present filler resides in securing the storage equipment for stayed liquid on the supply pipe, and introducing the stayed liquid in the stay portion to the storage equipment through the supply pipe. Consequently, the stayed liquid is capable of being collected without dropping the quality thereof, and thus, is economically re-used together with the fresh drink liquid from the resource not shown in the drawings.

DESCRIPTION OF THE PREFFERED EMBODIMENTS

In the following, the present invention will be described in detail with reference to the drawings.

Figure 1:
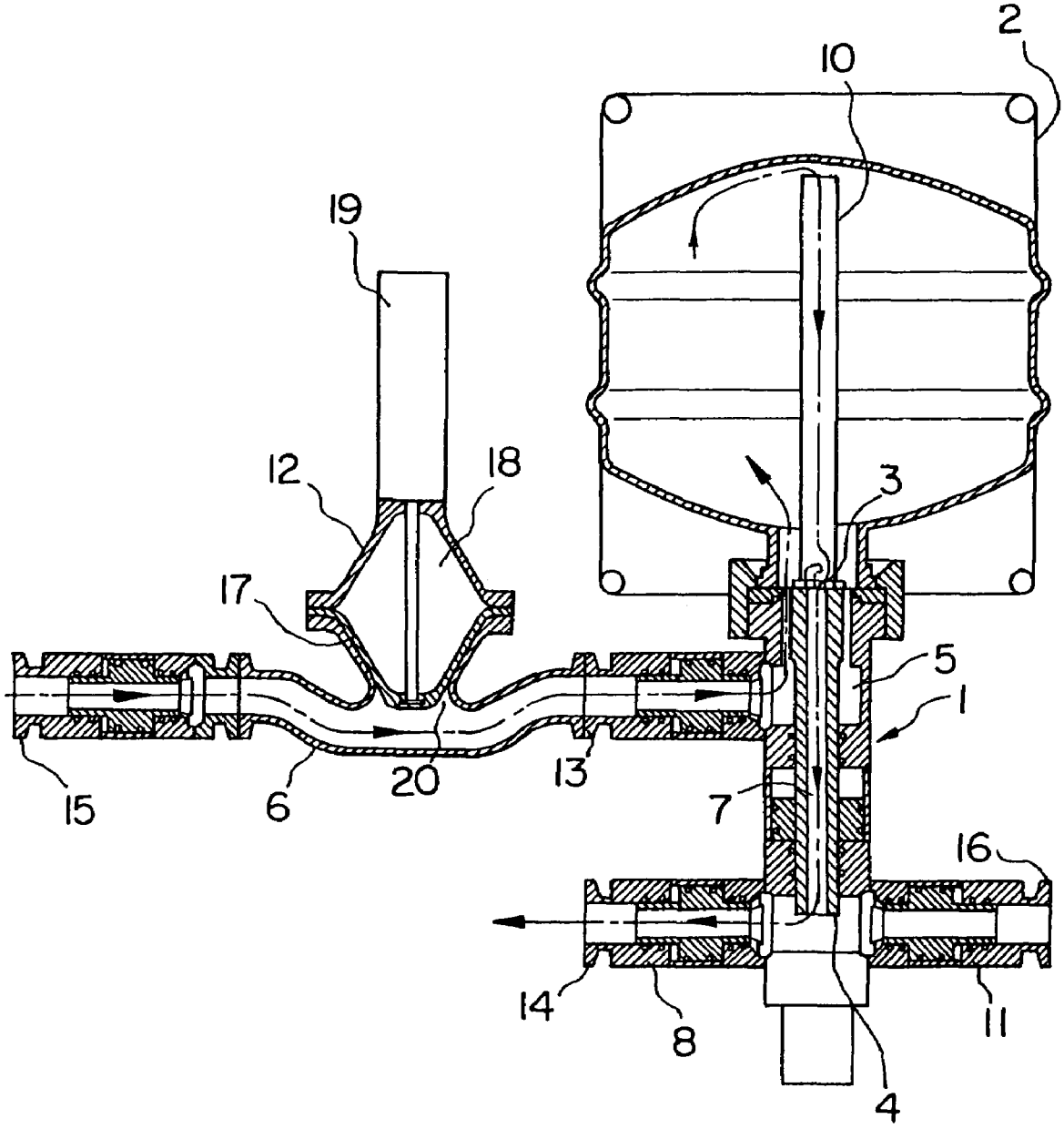
FIG. 1 is a cross section showing one kind of example of the present filler, and shows the states of the present filler, and shows the states of opening the cap and filling the drink liquid into the container.
Figure 2:
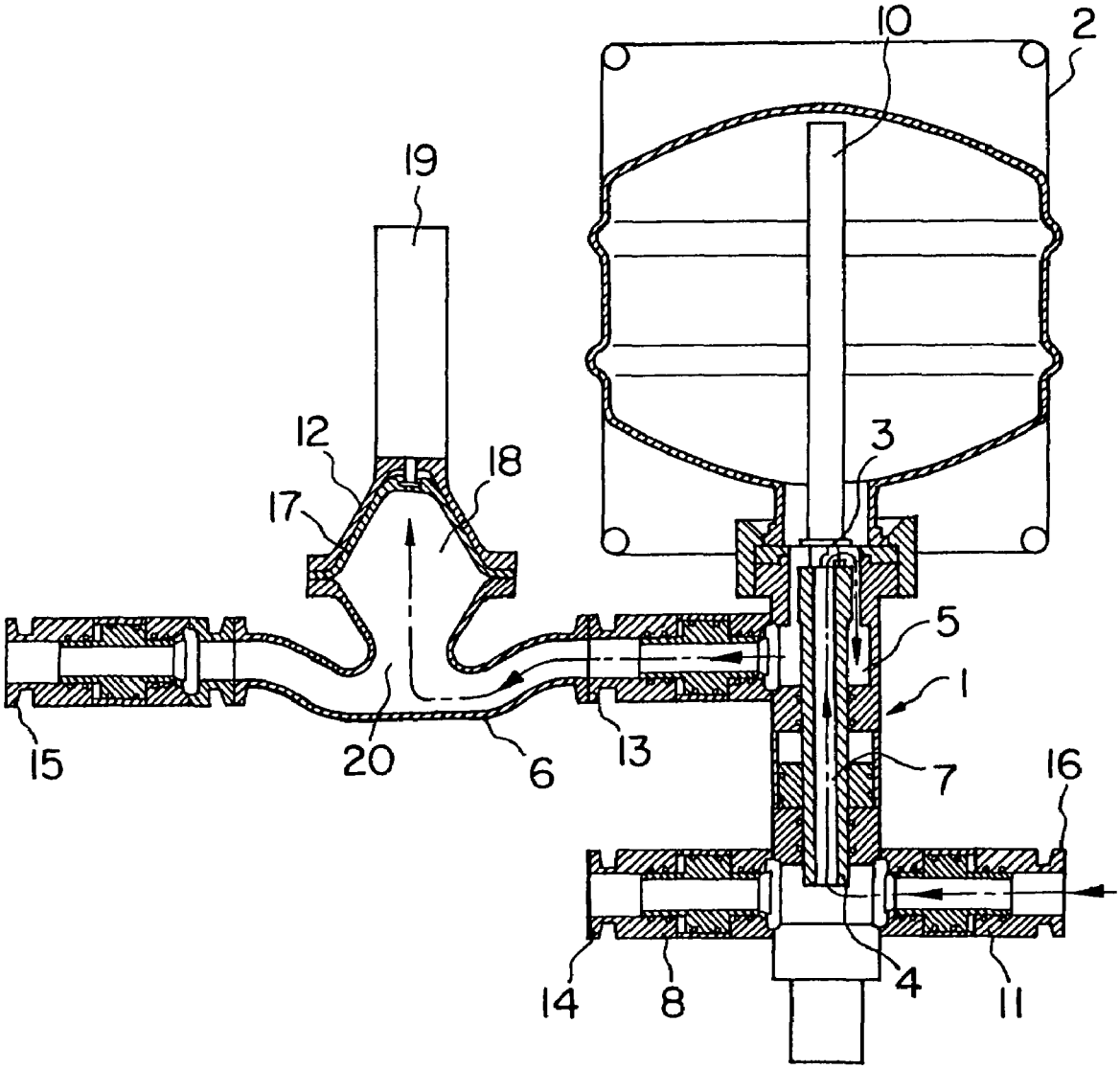
FIG. 2 is a cross section showing the states of closing the cap of the filler shown in FIG. 1, and introducing the liquid of the stay portion to the storage equipment.

In FIG. 1 and FIG. 2, the filler 1 for filling drink liquid of the present invention is such a type that container 2, such as barrel of beer is kept upside-down, and drink liquid, such as beer, soft drink etc., is filled through cap 3 from the lower part, and is composed of cylinder rod 4 connected to cap 3, discharge hole 7 longitudinally penetrated through a center of cylinder rod 4, stay portion 5 secured at the upper part of the periphery of cylinder rod 4, through which the drink liquid passes, and supply pipe 6 for drink liquid connected to stay portion 5. Each of stay portion 5 and discharge hole 7 is respectively connected into the inside of the container 2 by pushing up cylinder rod 4 and opening the cap 3 of container 2, and drink liquid is filled up into container 2 from supply pipe 6. At the same time, the air in container 2 is discharged through discharge hole 7. On supply pipe 6, storage equipment 12 for stayed liquid having storage room 18 is secured, and on stay portion 5, pipe 11 for introducing pressurized air is secured to be connected to stay portion 5 through discharge hole 7. As a result, stay portion 5 and exhaust hole 7 are both shut off from the inside of container 2 by pulling down cylinder rod 4 and closing the cap 3 of container 2, and then, the pressurized air is introduced into stay portion 5 from pipe 11 for pressurized air, and the stayed liquid in stay portion 5 is introduced into storage room 18 through supply pipe 6. Discharge hole 7 is connected to discharge line 8 and pipe 11 for pressurized air. Numeral 10 is air discharge pipe.

The characters of the present invention reside in securing storage equipment 12 for stayed liquid on the optional point of supply pipe 6, connecting stay portion 5 to supply pipe 6 and to pipe 11 for introducing pressurized air through discharge hole 7, closing cap 3 of container 2 by pulling down cylinder rod 4, and thereafter, introducing pressurized air into stay portion 5 from pipe 11 for introducing pressurized air through discharge hole 7, and sending stayed liquid of stay portion 5 to storage equipment 12 for stayed liquid through supply pipe 6.

Figure 3:
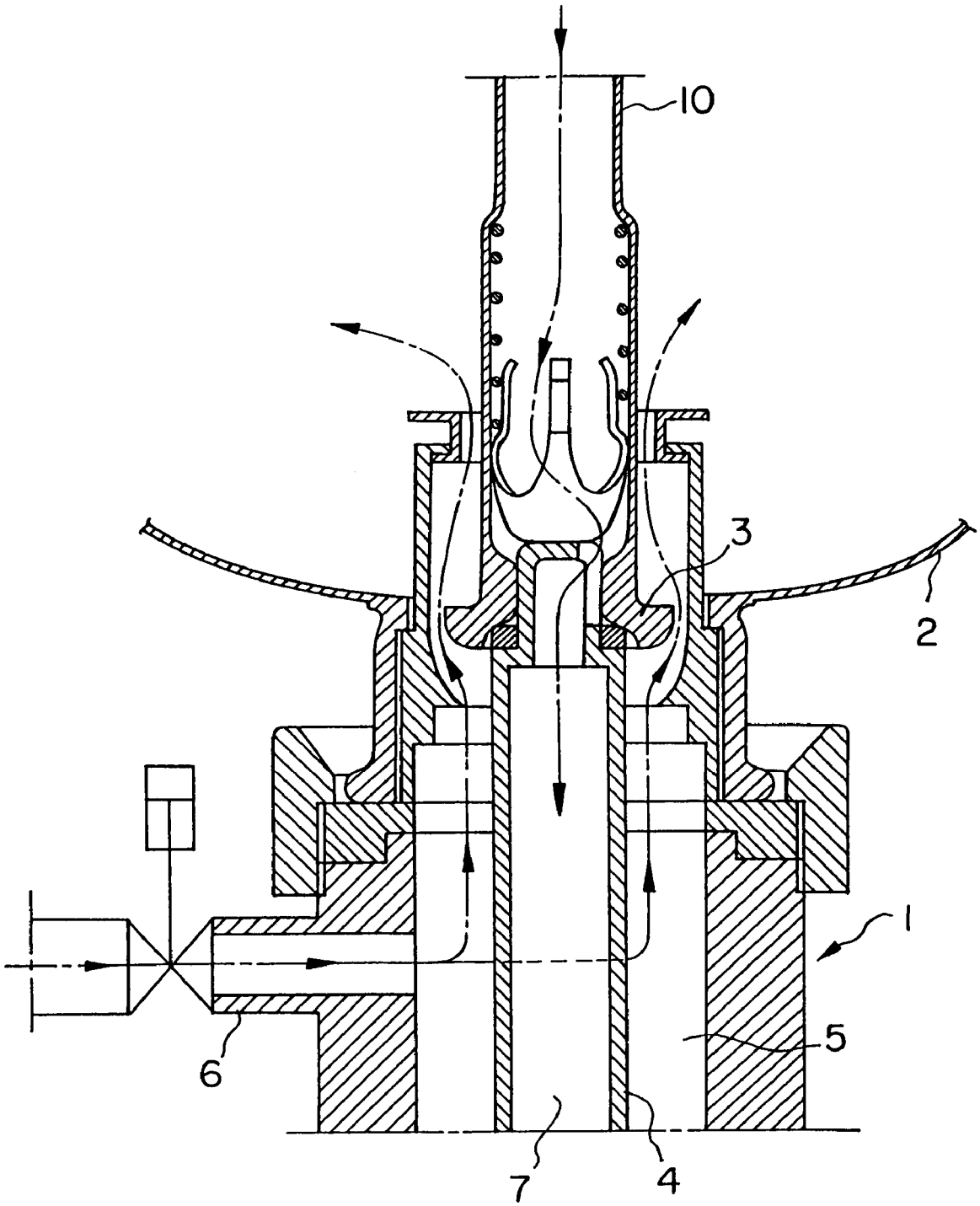
FIG. 3 is a partially enlarged cross section showing the opened cap.
Figure 4:
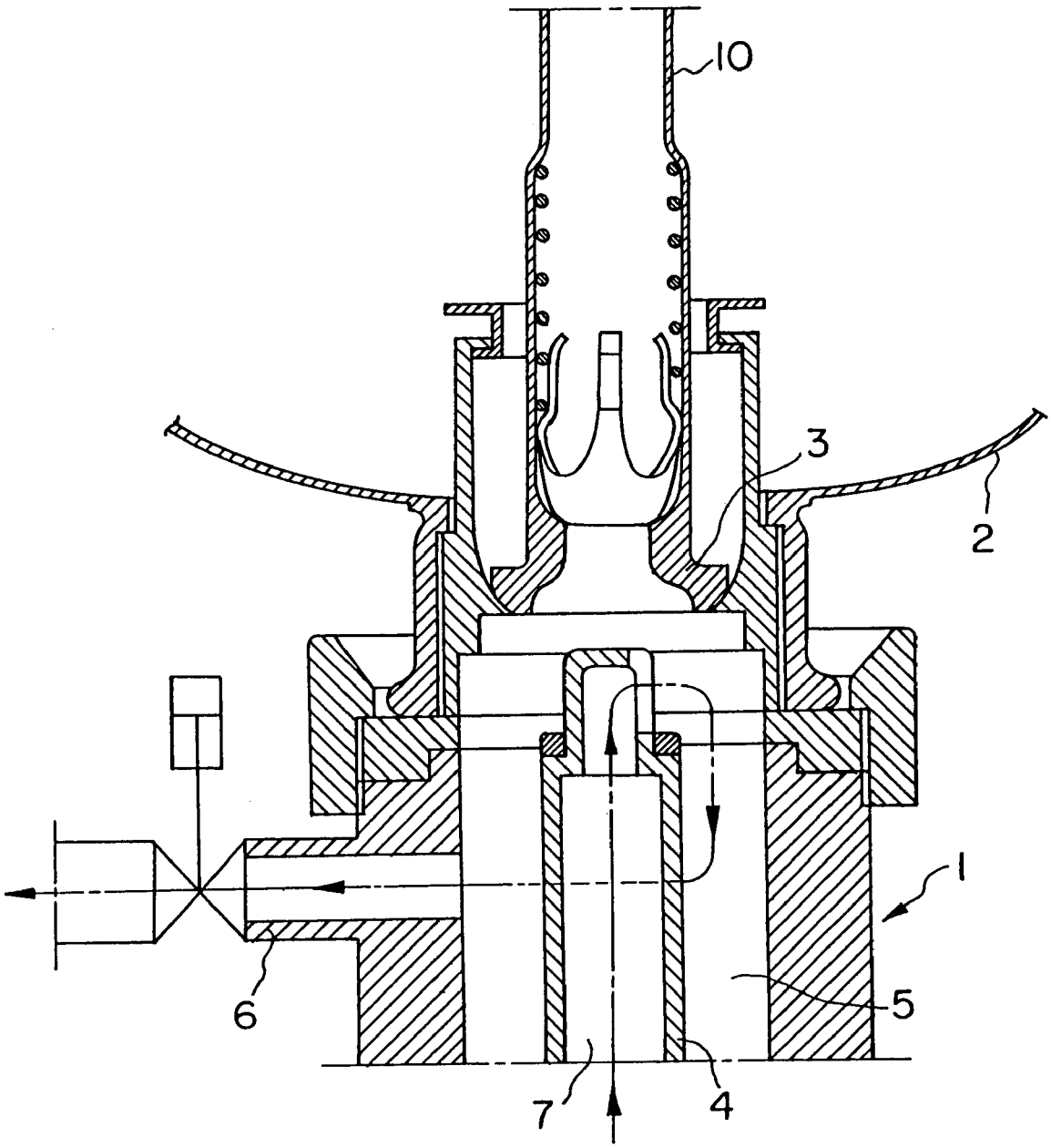
FIG. 4 is a partially enlarged cross section showing the closed cap.

The afore-mentioned filler 1 for filling drink liquid is operated as follows. At first, empty container 2 before filling is carried with a carrying machine not shown in the drawings, and after then, cylinder rod 4 is pushed up as shown in FIG. 3 to open cap 3 of container 2, and at the same time, to connect stay portion 5 to container 2. FIG. 1 is a cross section showing the state of opening cap 3 of filler 1 for filling drink liquid. Next, control valve 13 for drink liquid, control valve 14 for discharge air and control valve 15 for stayed liquid are all, opened, and as a result, supply pipe 6 for drink liquid is connected into the inside of container 2, and drink liquid is introduced and filled into container 2 toward the direction shown by an arrow through supply pipe 6 and stay portion 5 from supply source not shown in the drawings. At the same time, the air in container 2 is discharged from container 2 toward the direction of an arrow through pipe 10 for discharging air in container 2, discharge hole 7 longitudinally penetrated through a center of cylinder rod 4, and discharge line 8. At this time, stay portion 5 is occupied with drink liquid during the filling.

When the filling is reached to desired amounts, control valve 13 for drink liquid of supply pipe 6, control valve 14 for discharge gas of discharge line 8, and control valve 15 for stayed liquid are respectively closed. Thereby, the filling of drink liquid to container 2 is finished. At the same time, cap 3 of container 2 is shut by pulling down cylinder rod 4, thereby, the inside of container 2 is separated from filler 1 for filling drink liquid.

After then, control valve 13 for drink liquid and control valve 16 for pressurized air are both opened, and pressurized air is introduced into stay portion 5 in which the stayed liquid is stayed, through discharge hole 7 from pipe 11 for introducing pressurized air, and as a result, the stayed liquid in the stay portion 5 is pushed out to supply pipe 6, and finally is carried out to storage room 18 of storage equipment 12 for stayed liquid.

The storage equipment 12 is composed, as shown in FIG. 1, by storage room 18, driving device 19, such as air cylinder, connected on the top of storage room 18, and diaphragm 17 arranged on opening 20 for introducing stayed liquid, which is opened toward supply pipe 6. The storage room 18 is covered with diaphragm 17 as shown in FIG. 1, before the pressurized air is introduced into the discharge hole 7. When the stayed liquid is pushed out to the supply pipe 6 by the pressurized air, the diaphragm 17 is pushed up to the roof of the storage room 18 as shown in FIG. 2 by the operation of air cylinder 19 and the pressure of pressurized air, and the storage room 18 is opened. At this time, the stayed liquid is introduced and recovered into the storage room 18 in a direction shown by an arrow with the pressure of the pressurized air.

When the recovery of the stayed liquid is finished, the control valve 13 for drink liquid and the control valve 16 for pressurized air are closed. Thereby, the stayed liquid is tightly preserved in the storage room 18 of the storage equipment 12 for stayed liquid with keeping the pressure necessary for the quality of a liquid product. And the container 2 is removed from the filler 1 for filling drink liquid, and is transported with carrying machine not shown in the drawings. After then, next empty container is set up to the filler 1 for filling drink liquid in the same manner, and the filling operation starts in the same manner. At this time, the drink liquid preserved in the storage equipment 12 for stayed liquid is used in the next filling.

Figure 5:
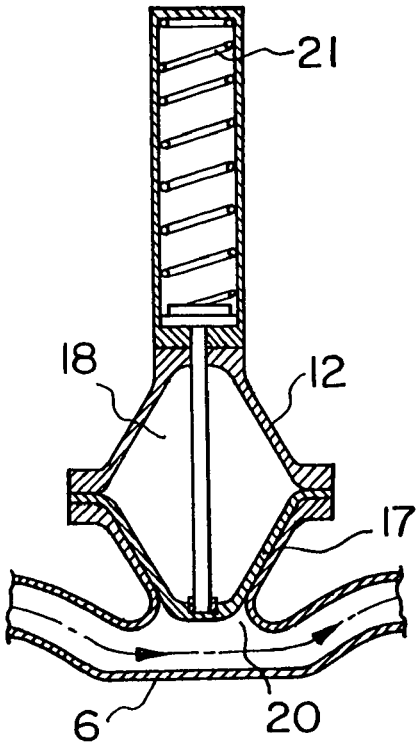
FIG. 5, FIG. 6 and FIG. 7 are respectively a cross section, each showing different type of storage equipment.
Figure 6:
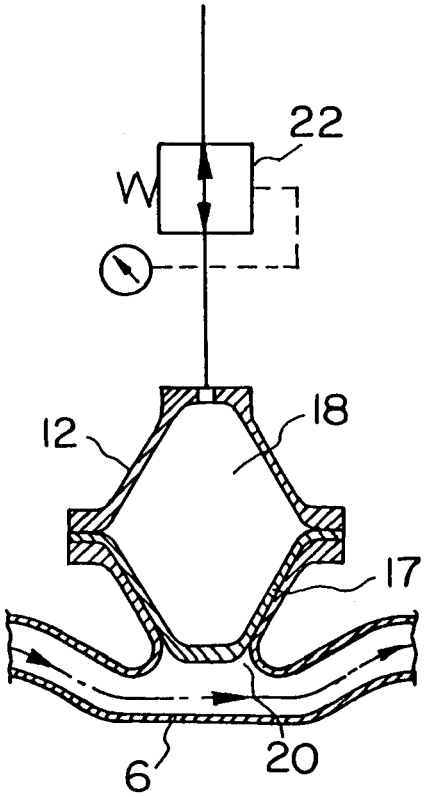
Figure 7:
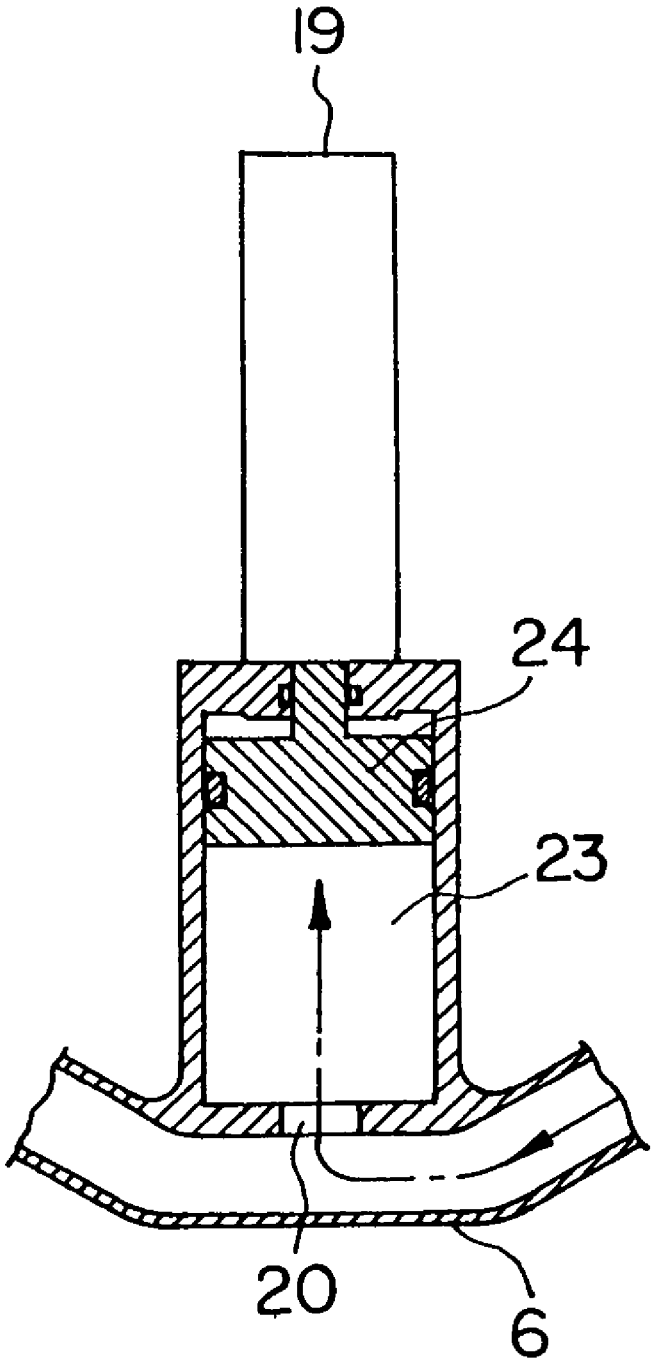
Figure 8:
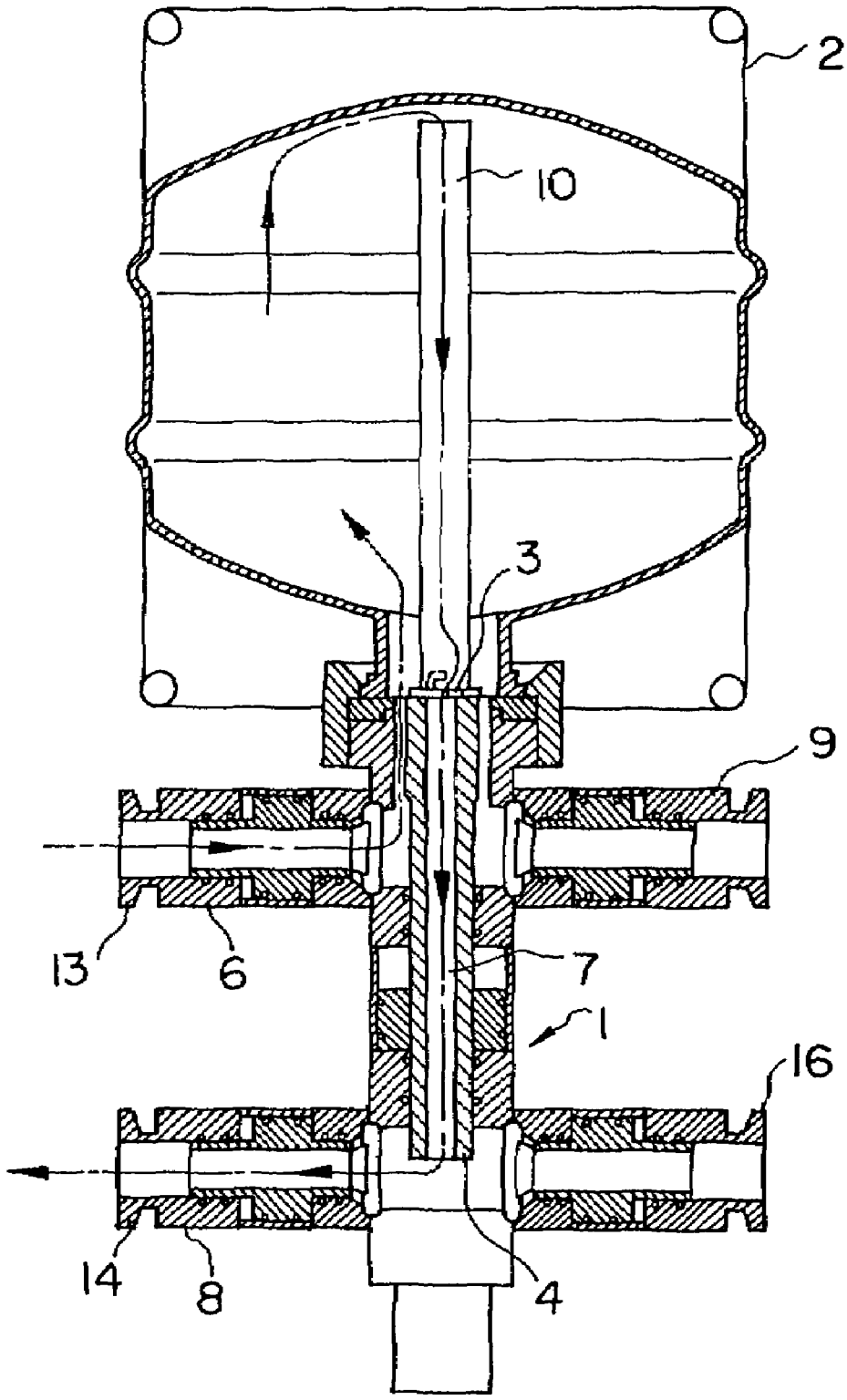
FIG. 8 is a cross section showing the known filler.

The driving device 19 driving the diaphragm 17 of the storage equipment for stayed liquid can be an operating spring 21 as shown in FIG. 5. Also, it can be a valve 22 for adjusting pressure as shown in FIG. 6. Further, the storage room 18 of the storage equipment 12 for stayed liquid can be composed by piston room 23 as shown in FIG. 7, and the stayed liquid in the storage room 18 of the storage equipment 12 for stayed liquid can be inhaled or discharged by driving piston 24 in the piston room 23 with driving device 19, such as air cylinder.

The filler for filling drink liquid of the present invention is composed by arranging the storage equipment for stayed liquid on the supply pipe, and introducing the stayed liquid stayed in the stay portion into the storage equipment for stayed liquid through the supply pipe. And accordingly, it can accomplish the advantages of recovering the stayed liquid without a dropping of the quality, and economically re-used by mixing with the drink liquid from a supply resource not shown in drawings during the filling. Then, the present filler is preferably utilized in the factories for drink liquid, such beer brewery, soft drink manufacturing, etc.

What is claimed is:

1. A filler for filling drink liquid into a container from the bottom thereof through a cap, comprising a cylinder rod connected to the cap of the container, a discharge hole longitudinally penetrated through a center of the cylinder rod, a stay portion secured at the upper part of the periphery of the cylinder rod, through which the drink liquid passes, and a supply pipe for drink liquid connected to the stay portion, wherein each of the stay portion and the discharge hole is respectively connected into the inside of the container by pushing up the cylinder rod and opening the cap of the container, and the drink liquid is filled up into the container from the supply pipe through the stay portion, characterized in that: a storage equipment for stayed liquid having a storage room is secured on the supply pipe, and a pipe for introducing pressurized air is secured to be connected to the stay portion through the discharge hole, thereby the stay portion and the discharge hole are shut off from the inside of the container by pulling down the cylinder rod and closing the cap of the container, and then, the pressurized air is introduced into the stay portion from the pipe for pressurized air and the stayed liquid in the stay portion is introduced into the storage room through the supply pipe.

2. The filler for filling drink liquid claimed in claim 1, wherein a driving device is installed in the storage equipment to easily control the backpressure toward the storage room, thereby simplifying suck and discharge of the stayed liquid in the storage equipment by driving the driving device.

3. The filler for filling drink liquid claimed in claim 2, wherein a diaphragm driven by the driving device is installed in the storage equipment to cover an opening for introducing the stayed liquid, opened in the supply pipe of the storage room, thereby sucking and discharging the stayed liquid in the storage equipment by driving the diaphragm.

4. The filler for filling drink liquid claimed in claim 3, wherein the driving device is air cylinder, spring or pressurized liquid.

5. The filler for filling drink liquid claimed in claim 1, wherein the storage room of the storage equipment is composed by piston room, thereby sucking and discharging the stayed liquid in the storage equipment by driving the piston in the room.

6. The filler for filling drink liquid claimed in claim 1, wherein the drink liquid is beer or bubbled soft drink.

* * * * *